United States Patent [19]

Anderson et al.

[11] Patent Number: 4,875,052

[45] Date of Patent: Oct. 17, 1989

[54] ADJUSTABLE ORIENTATION APPARATUS WITH SIMULTANEOUS ADJUSTMENT OF POLAR AND DECLINATION ANGLES

[75] Inventors: Dean H. Anderson; Mark M. Tomann, both of Garrison, N.Y.

[73] Assignee: Hudson Valley Metal Works, Inc., Newburgh, N.Y.

[21] Appl. No.: 874,426

[22] Filed: Jun. 16, 1986

[51] Int. Cl.[4] ..... H01Q 1/12; H01Q 3/08

[52] U.S. Cl. ..... 343/882; 248/183

[58] Field of Search ..... 343/878, 880, 882, 765, 343/766, 757, 916; 248/183, 184, 515

[56] References Cited

U.S. PATENT DOCUMENTS 4,126,865 11/1978 Longhurst et al. ..... 343/766

4,528,569 7/1985 Felter et al. ..... 343/882

4,602,259 7/1986 Shepard ..... 343/882

4,626,864 12/1986 Micklethwaite ..... 343/882

4,692,771 9/1987 Rothbarth et al. ..... 343/882

*Primary Examiner*—William L. Sikes

*Assistant Examiner*—Michael C. Wimer

*Attorney, Agent, or Firm*—Irving M. Weiner; Robert M. Petrik; Roland W. Norris

[57] ABSTRACT

An adjustable orientation apparatus which can be used, for example, to track a satellite. An antenna mounting plate is oriented in accordance with the latitude angle and the declination angle of the satellite to be tracked. Special angle adjustment and camming members permit the antenna mounting plate to be oriented in accordance with the latitude angle and the declination angle by way of a single adjustment.

5 Claims, 9 Drawing Sheets

FIG. 1
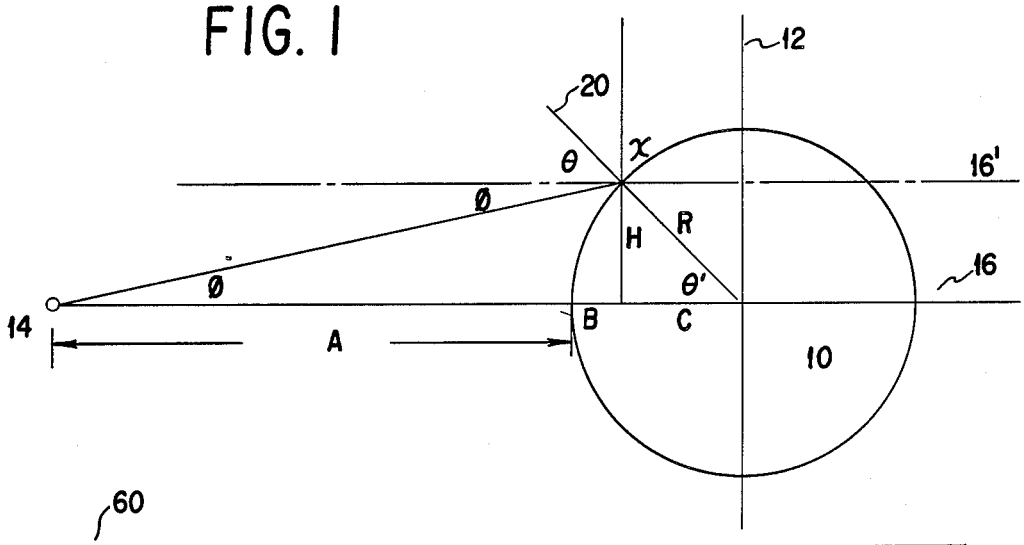
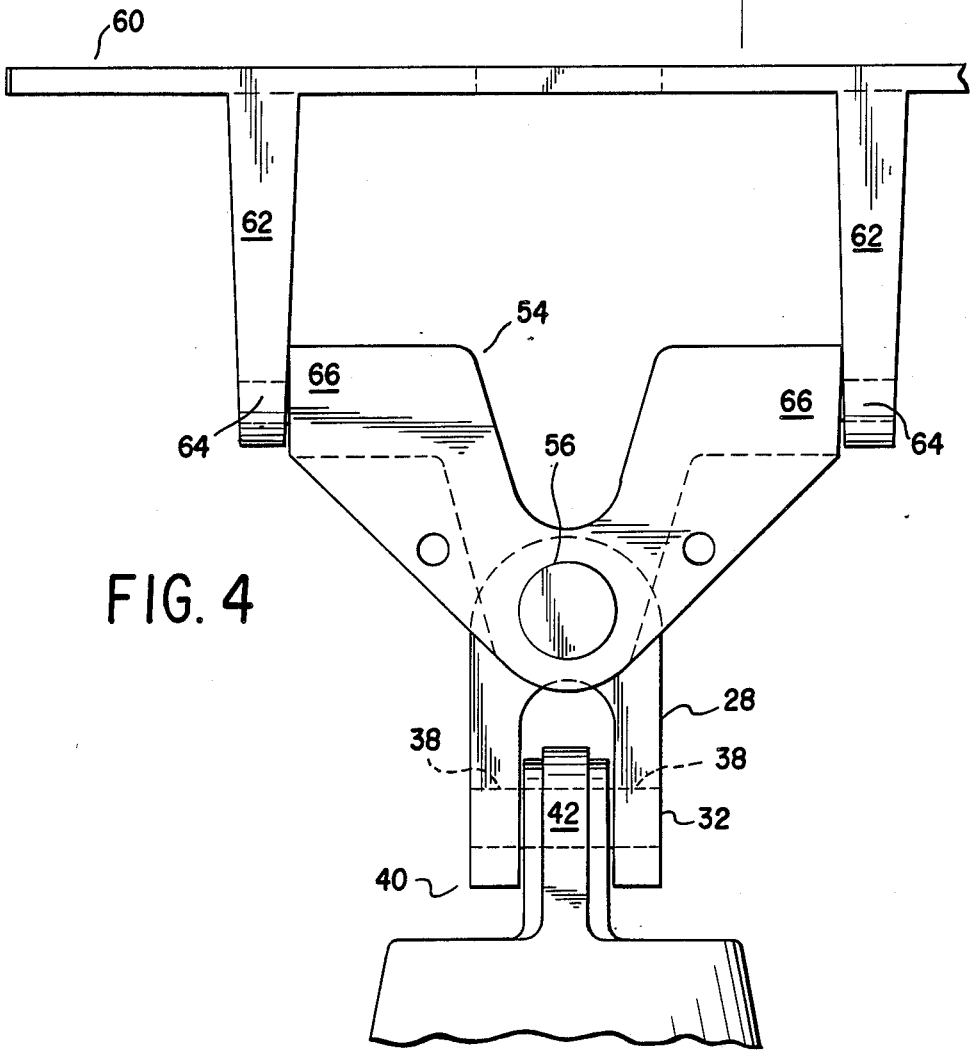
FIG. 4

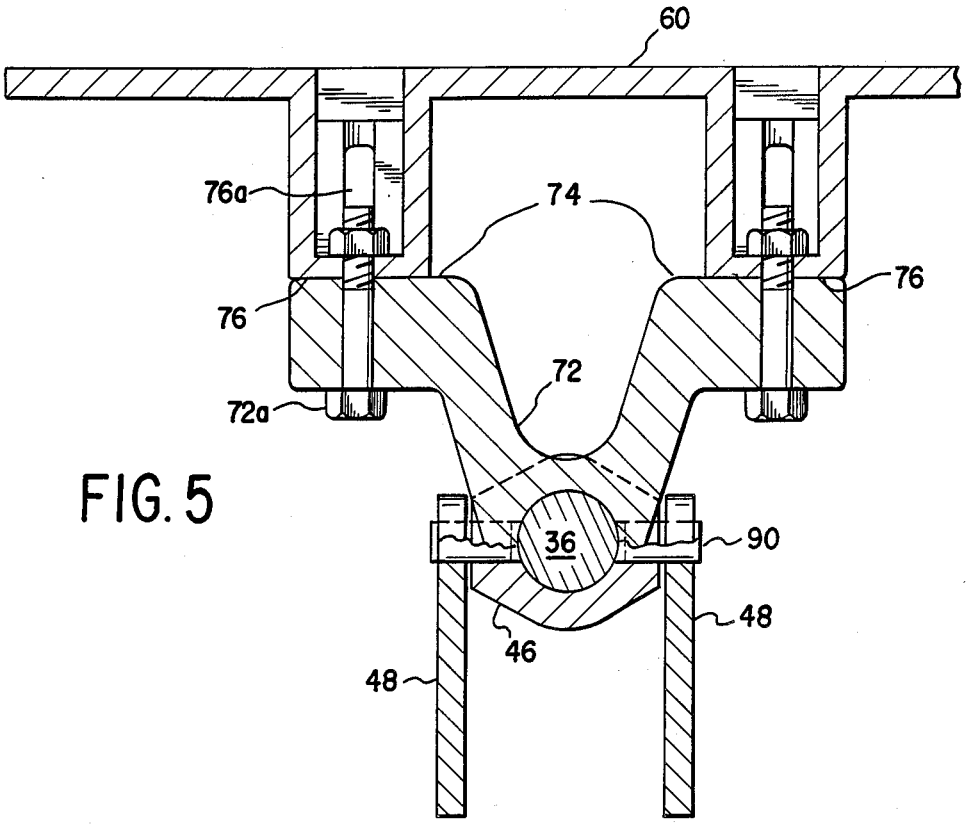
FIG. 5
FIG. 6
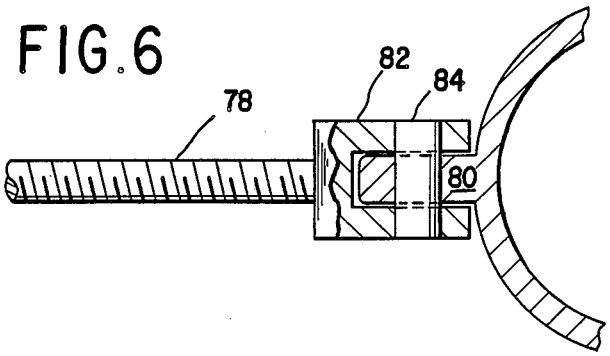

ADJUSTABLE ORIENTATION APPARATUS WITH SIMULTANEOUS ADJUSTMENT OF POLAR AND DECLINATION ANGLES

BACKGROUND OF THE INVENTION

1. Field of the Invention

The present invention relates generally to an adjustable orientation apparatus, and methods of constructing and utilizing same. More particularly, the present invention relates to an antenna mounting apparatus for use in receiving signals from or transmitting signals to geosynchronous satellites, and methods of constructing and utilizing such apparatus.

2. Description of the Relevant Art

The availability of systems for the reception of television microwave signals transmitted by communication satellites has created a demand for antennas and related hardware with which to receive such satellite transmissions. Such satellites are normally in a geosynchronous orbit. In such an orbit the satellite rotates about the Earth's axis at the same rotational rate as the Earth, thus allowing the satellite to maintain a fixed position with respect to the Earth's surface. The orbit of the majority of communication satellites is approximately 22,300 miles above the Earth's surface in the Earth's equatorial plane, concentric with the true axis of the Earth's rotation. This orbital location is also known as the Clarke Belt.

In order to properly aim an antenna at a satellite in a geosynchronous orbit the antenna should ideally rotate about the Earth's polar axis. The tracking error introduced by having the polar axis of the Earth and the rotational axis of the antenna parallel, but not coinciding, is negligible for certain wavelengths. Thus, an antenna may be placed at any location and still track the satellite orbital ring.

Aiming consists of two adjustments. The first adjustment orients the antenna's polar axis at an angle equal to the latitude of the antenna mount. The second adjustment, called the declination, focuses the antenna upon the satellite ring. Such declination is a function of both the antenna's latitude and the radius of the satellite orbit.

Conventional antenna technology requires the two angular adjustments to be made independently. This is inconvenient, time consuming, and a source of human error.

It is accordingly a purpose of the present invention to provide an antenna mount whereby automatic simultaneous declination compensation is a function of proper latitude angle.

The relevant art is exemplified by: Balton U.S. Pat. No. 2,572,430; Scrafford et al U.S. Pat. No. 3,714,660; Wild U.S. Pat. No. 3,940,771; Hubbard U.S. Pat. No. 3,977,773; VanderLinden, Jr. et al U.S. Pat. No. 4,086,599; Gaechter et al U.S. Pat. No. 4,145,021; Savalle, Jr. et al U.S. Pat. No. 4,232,320; Gurney et al U.S. Pat. No. 4,404,565; and Major et al U.S. Pat. No. 4,454,515.

There were and are a plethora of problems attendant the structures prior to the advent of the present invention. Notably, the prior structures require multiple and independent adjustments in order to achieve the desired orientation of the structure. In contrast, the present invention requires only a single adjustment in order to achieve the desired simultaneous and automatic orientation with respect to two predetermined angles.

SUMMARY OF THE INVENTION

Although a preferred embodiment of the invention relates to an apparatus for receiving signals from and/or transmitting signals to a geostationary satellite, the present invention is not intended to be limited in its scope to such preferred embodiment. The invention has broad application to any field requiring an adjustable orientation apparatus, including, but not limited to, antenna structures, variable angle support devices, solar energy concentrators, subatomic particle bombardment devices, altazimuth orientation devices, heliostat supports, biomedical orientation devices, various reflection devices and in general any devices requiring the transmission, reception and/or reflection of any wave or particle phenomena.

The present invention provides an adjustable orientation apparatus, including first means, such as a home satellite receiving dish or mounting plate therefor, to be oriented in accordance with a first predetermined angle and a second predetermined angle. The apparatus also includes base means operably interconnected with and supporting the first means to be oriented. The apparatus also includes adjustable second means for orienting the first means in accordance with the first predetermined angle and the second predetermined angle by way of a single adjustment of the adjustable second means. The second means is operably interconnected with and disposed between the first means and the base means.

A further purpose of the present invention is to provide an antenna mount which may be readily, installed, and therefore simple and efficient to use.

In accordance with the above and other purposes, the antenna mount of the present invention may comprise, in one possible embodiment, a vertical base upon which a polar axis shaft is supported for pivoting in the north-south direction. An antenna plate is operably connected to the polar axis shaft and is rotatable about a polar axis extending in the north-south direction, as well as being rotatable about a second axis oriented in the east-west direction. Means are provided for adjusting and maintaining the polar axis shaft at an angle equal to the latitude of the antenna, and by further mechanical means operatively connected to the antenna mounting plate to rotate about the polar axis while being offset from that axis by an amount equal to the declination angle corresponding to that latitude. Accordingly, both proper declination and polar angle can be provided by one adjustment.

A fuller understanding of the present invention, as well as other objects and advantages thereof, will become apparent from inspection of the following description and drawings which depict some illustrative embodiments of the invention.

BRIEF DESCRIPTION OF THE DRAWINGS

FIG. 1 is a schematic representation of the Earth and satellite orbits, showing the relationship therebetween.

FIG. 4 is a view taken along line 4—4 in FIG. 3.

FIG. 5 is a sectional view taken along line 5—5 in FIG. 3.

FIG. 6 is a sectional view taken along line 6—6 in FIG. 3.

DETAILED DESCRIPTION OF SOME PREFERRED EMBODIMENTS

Figure 2:
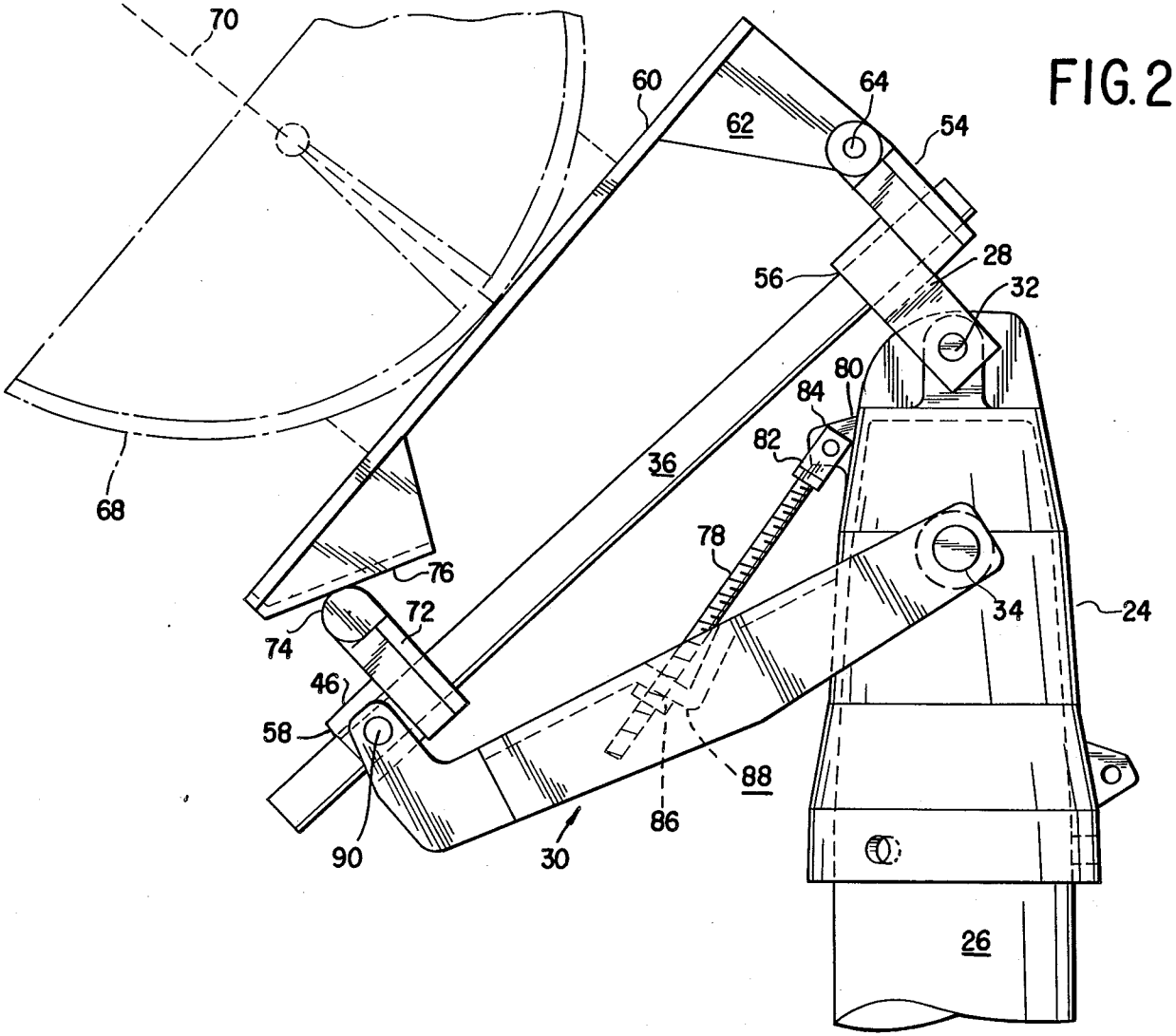
FIG. 2 is a side elevation view of the mount of the present invention in a first, lowered position.

Referring initially to FIG. 1, the Earth 10 has rotational or polar axis 12. A satellite 14 is located along the Earth's equatorial plane 16 at a distance A of approximately 22,300 miles from the Earth's surface.

To create an axis parallel to the Earth's polar axis 12 at a point X a support post 20 is mounted vertically or upright at the location. It may be seen that the antenna will sweep a plane 16′ parallel to equatorial plane 16 if elevation angle $\theta$ corresponds to the latitude of position X.

Once the latitude plane 16′ is established, the angular positioning of the antenna must be further adjusted by declination angle $\phi$ to compensate for the fact that the satellite 14 is located on the equatorial plane 16 rather than on the latitude plane 16′ of the antenna. As may be seen from inspection of FIG. 1, declination angle $\phi$ is dependent both upon location or latitude of the antenna and the distance A of the satellite from the Earth's surface. In view of the fact that the commercial television broadcast satellites are all located within the Clarke Belt, the distance A may be considered a constant; in which case the declination angle $\phi$ is dependent solely upon the latitude $\theta$ or $\theta'$.

Figure 3:
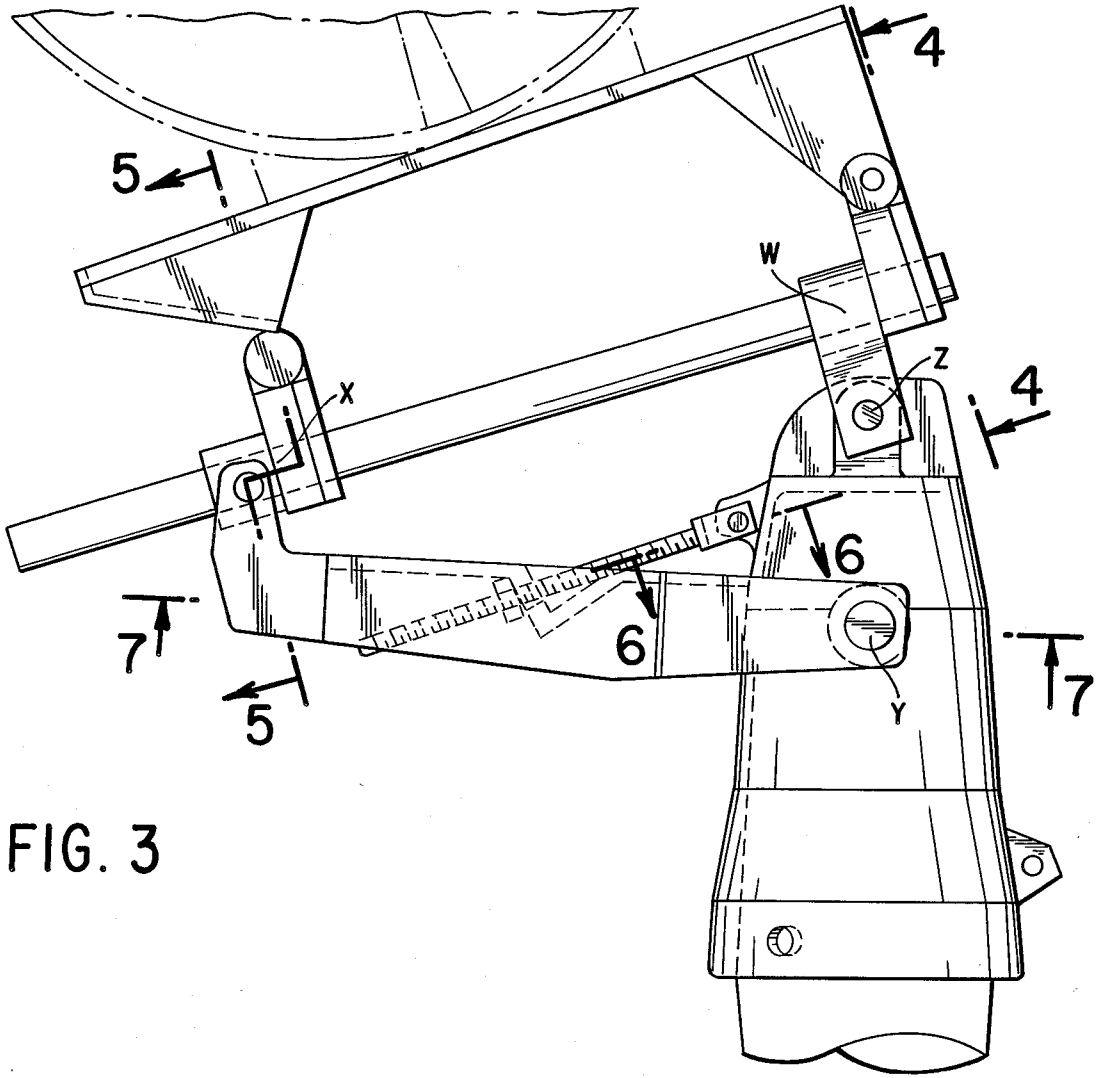
FIG. 3 is a side elevation view of the mount depicting the mount in a second raised position.

By the use of geometrical relationships $\phi$ can be determined as $$\phi = \tan^{-1} H/(A+B)$$

Where in FIG. 1

$$B+C=R=3{,}960 \text{ miles}$$

Where $H=3{,}960 \sin \theta'$ $C=3{,}960 \cos \theta'$ $B=3{,}960-C$; and $A=22{,}300$ miles Referring next to FIGS. 2 and 3, the antenna mount of the present invention includes base 24, which may be in the form of a casting designed to be affixed to the top of an upright, rigidly supported pipe 26. Mounted for rotation in substantially parallel, substantially vertical planes are first and second support arms 28 and 30 journaled for rotation about parallel substantially horizontal pivot pins 32 and 34, respectively, the axes of which are located in a common plane.

First and second support arms 28 and 30 support polar axis shaft 36, which is journaled for rotation within bores 56 and 58 in the support arms 28 and 30, respectively.

As may be best seen in FIG. 4, first support arm 28 is provided with a forked end 40 having bores 38. End 40 embraces flange 42 on base 24, and rotates about pivot pin 32.

Figure 7:
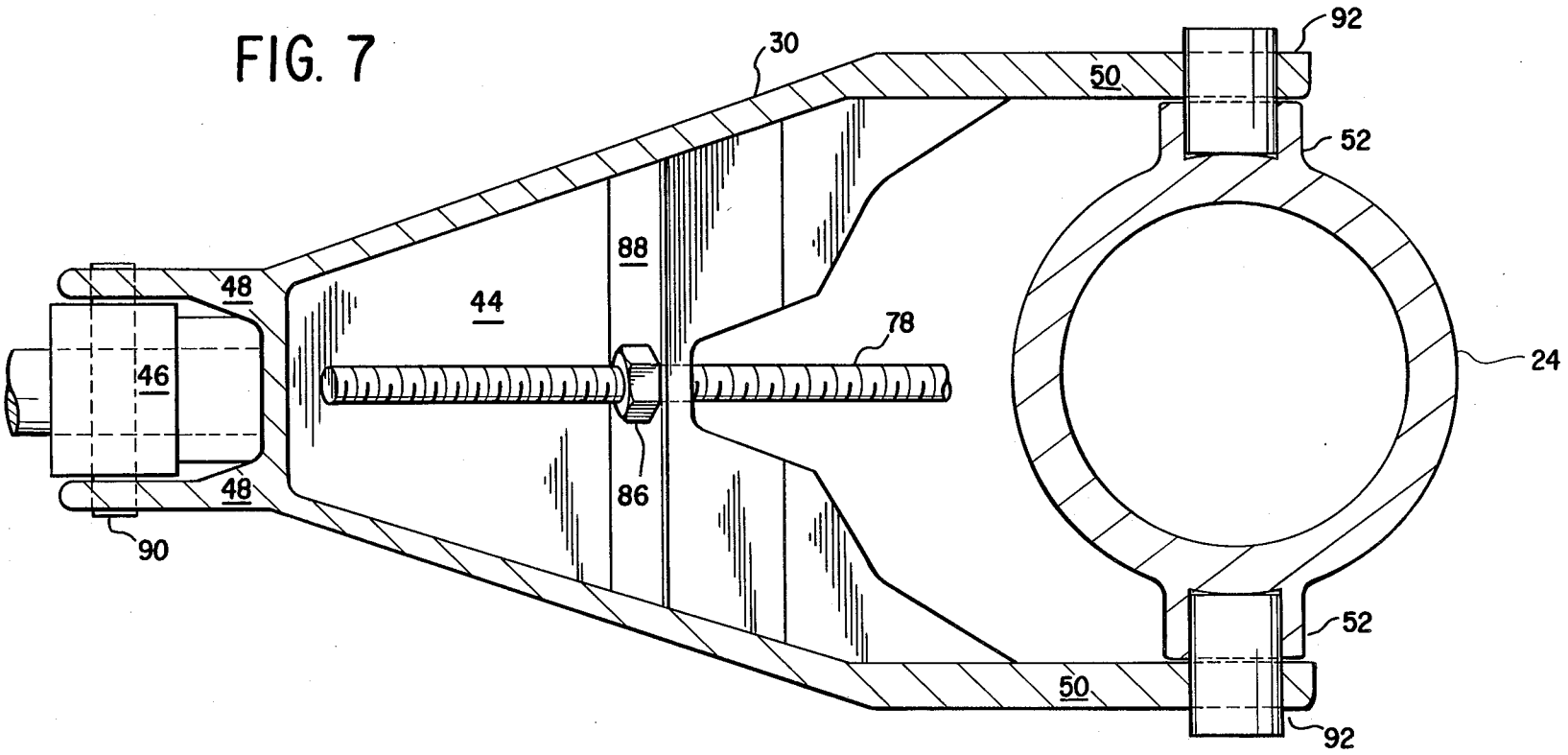
FIG. 7 is a sectional view taken along line 7—7 in FIG. 3.

Second support arm 30, as seen in FIG. 7, includes main casting piece 44 and polar axis shaft support bearing 46 mounted between arms 48. Polar axis shaft support bearing 46 pivots about pins 90 held by arms 48. Second support arm 30 also has base-embracing arms 50 bearing bores 92, in which ride pivot pins 34 extending from bosses 52.

With reference to FIGS. 2 and 4, mounted at the upper end of polar axis shaft 36 is pivot casting 54 which is firmly affixed to the polar axis. Shaft 36 pivots and rotates within bores 56 and 58 while being supported by first support arm 28.

Referring to FIG. 4, antenna mounting plate 60, having mounting flanges 62 projecting downwardly from a first end thereof, is journaled for rotation about declination pivot pins 64 projecting outwardly from arm portions 66 in pivot casting 54. As seen in FIGS. 2 and 3, antenna 68 is mounted to antenna mounting plate 60 such that its focal axis 70 is normal to the plane of the mounting plate.

As can be seen in FIGS. 2 and 5, sliding cam member 72 is slidably mounted to polar axis shaft 36, and includes cam surfaces 74 projecting upwardly to contact depending cam plate surfaces 76, projecting downwardly and offset from antenna mounting plate 60.

Referring next to FIGS. 2 and 6, threaded adjustment rod 78 is pivotally mounted upon flange 80 of base 24 by clevis 82 having pivot pin 84, and is provided with adjustment nut 86 which bears upon inclined surface 88 of main casting plate 44, as seen in FIG. 7.

As may be appreciated, the adjustment of nut 86 varies the effective distance between inclined surface 88 and flange 80, thus causing arm 30 to pivot about pivot rods 34. This pivoting action in turn causes the vertical angle of polar axis shaft 36 to change. The proper adjustment of nut 86 allows polar axis shaft 36 to be set at the appropriate angle with respect to the horizontal.

As second support arm 30 pivots, the distance between first support arm 28 and polar axis shaft support bearing 46 changes. Inasmuch as the upper end of polar axis shaft 36 is maintained in position with respect to first support arm 28 by pivot casting 54 resting against first support arm 28, such changes in distance cause polar axis shaft support bearing 46 to slide along the polar axis shaft. Because sliding cam member 72 rests against polar axis shaft support bearing 46, it also moves along polar axis shaft 36 in response to changes in the position of second support arm 30. As cam member 72 moves, its cam surfaces 74 bear against inclined cam plate surfaces 76, thus pivoting antenna mounting plate 60 with its affixed antenna 68 about declination pivot pins 64. Thus, as the polar angle of polar axis shaft 36 is set, the declination of the antenna is at the same time adjusted and set.

From the foregoing it will be understood that sliding cam member 72 is normally held against outward movement along polar axis shaft 36 by means of support bearing 46 against which it abuts. Thus, with an antenna 68 mounted on antenna mounting plate 60 as shown in FIG. 2, the forces are such that cam surfaces 74 of cam member 72 will bear against inclined cam plate surfaces 76 and cam member 72 will be held stationary by support bearing 46. During adjustment of nut 86, on the other hand, the contact point on cam plate surfaces 76 changes proportionally, keeping declination angles constantly in calibration with elevation of polar axis shaft 36. The cam plate surfaces 76 thus define a proportional ramp.

As shown in FIG. 5, the proportional ramp members depending from antenna mounting plate 60 and having the cam plate surfaces 76 defined therealong are each provided with a grooved opening 76*a* (indicated by dashed line in FIG. 2). Such grooved openings 76*a* are adapted to receive fastening means, such as bolts 72*a* respectively extending through suitable bolt holes provided in cam member 72, to protect against relative shifting of cam surfaces 74, 76.

In order to obtain the proper relationship and tracking between declination and latitude (polar angle) adjustments, certain relationships must be established and maintained between the various elements of the apparatus. As depicted in the geometrical representation of FIG. 8: point W represents the intersection of the center lines of polar axis shaft 36 and first support arm 28; point X represents the intersection of the center lines of polar axis shaft 36 and second support arm pivot pins 90; point Y is the axis of second pivot pin 34, and point Z is the axis of first pivot pin 32. With these points defined, the following relationships exist.

Because mounting post 26 is vertical, when polar axis shaft 36 is set to the correct latitude angle:

$$A = 180 - \text{latitude, and}$$

$$a^2 = b^2 + c^2 - 2bc \cos A.$$

Because pivot distance "b" and support arm distance "c" are fixed, distance "a" can be calculated for a given latitude.

Using the law of sines:

$$B = \sin^{-1}\left(\frac{b \sin A}{a}\right)$$

Because the angles of a triangle total 180 degrees:

$$C = 180 - A - B \text{ and } \beta = 90 - B.$$

Within triangle WXY:

$$\frac{\sin \beta}{d} = \frac{\sin \gamma}{a}, \text{ thus}$$

$$\gamma = \sin - 1\left(\frac{a \sin \beta}{d}\right)$$

$$\text{and } \alpha = 180 - \gamma - \beta$$

Similarly, $$\text{as } \frac{\sin \beta}{d} = \frac{\sin \alpha}{r1} \text{ in triangle } WXY$$

$$r1 = \frac{d \sin \alpha}{\sin \beta}$$

In one particular embodiment of the present invention, the dimensions, b=4.25 inches, c=2.25 inches, and d=12.626 inches provide a convenient range of rl for a reasonable latitude adjustment range.

Figure 8:
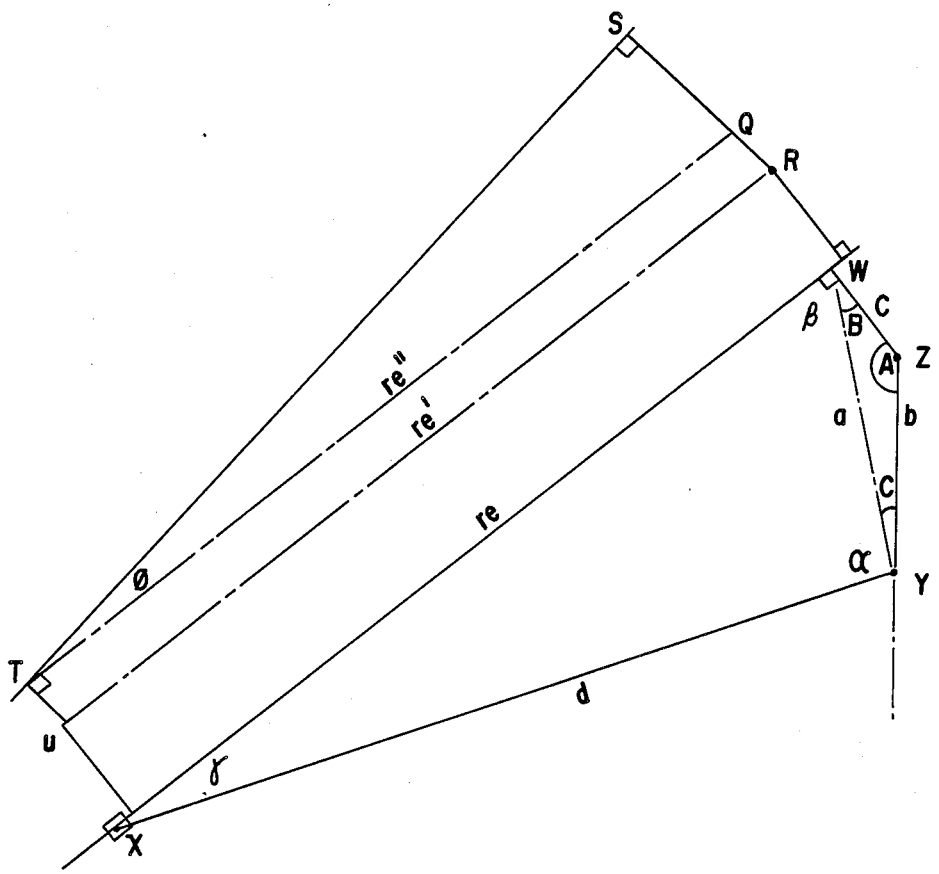
FIG. 8 is a schematic representation of the geometry of the invention by which the proper relationship between the elements can be determined.

With length rl established (and approximately equal to rl′ and rl″) and the declination angle $\phi$ being previously developed for a given latitude, referring to FIG. 8, the following relationship is established:

$$SQ = rl \sin \phi,$$

more accurately, $SQ = rl'' \sin \phi$.

The relationship between rl, rl′ and rl″ and the use of SQ to generate the distance from top plate to cam surface VT, is discussed below with reference to FIG. 9.

Installation of the antenna mount at the appropriate location is easily accomplished by aligning base 24 in the fully upright and vertical position upon pipe 26 or other appropriate support. The unit is then rotated until polar axis shaft 36 is oriented in a north-south direction. Base 24 may be provided with appropriate locking means to maintain the assembly in the correct orientation. Adjustment nut 86 is then turned as required until the angle of polar axis shaft 36 from the horizontal equals the latitude of the unit. Such adjustment is possible for a wide range of latitudes, as illustrated by the differences in polar axis shaft positions shown in FIGS. 2 and 3. Such adjustment automatically causes the proper declination for the antenna 68. The antenna may then be simply pivoted about the axis of polar axis shaft 36, tracking the Clarke Belt until reception or transmission of the desired satellite broadcast is made.

The following description begins with the understanding that rl and the corresponding declination angle are known for a certain range of latitude adjustments.

Figure 9:
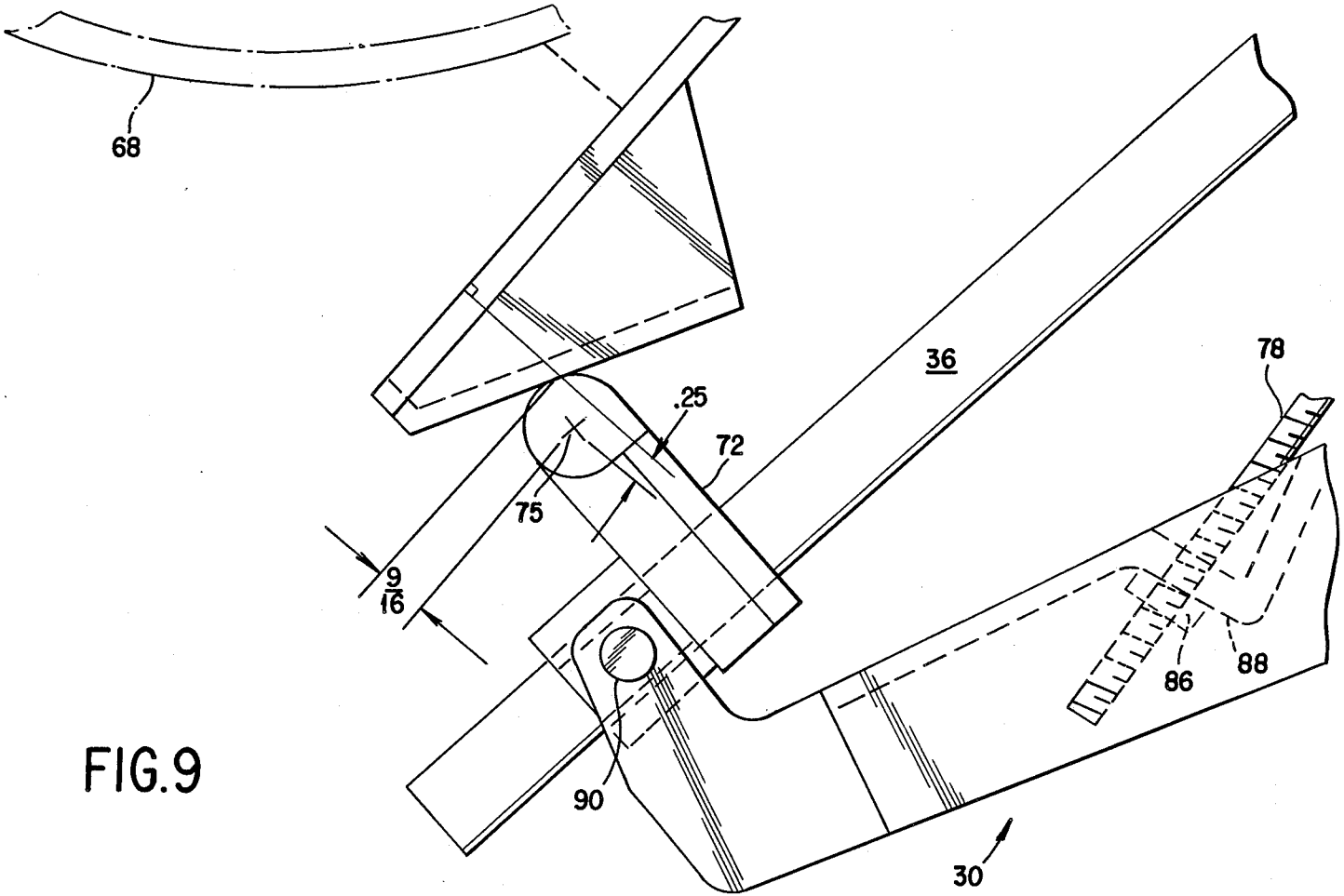
FIG. 9 depicts an englarged view of a portion of FIG. 2 to more clearly show the camming means.

With reference to FIGS. 2, 8 and 9:

point X of FIG. 8=point 90 of FIG. 2
point Y=point 34
point Z=point 32
point W=center point of bore 56
point R=point 64
point U=point 75 (see FIG. 9)
line TS=plate 60

Line SQR and line RW are pivotable at point R. Points Z, Y and X are also pivot points. Point X slides along shaft 36, creating length rl between centerlines of castings 72 and 54. rl′ is created because cam surface 76 does not contact top surface of casting 72 directly above center point 75 (FIG. 9), but rather approximately 0.25″ to the right as drawn. The distance above center point 75 to the cam surface contact point is 9/16″ if measured perpendicular to plate 60. These distances vary insignificantly over the range of latitude adjustments that are possible with this antenna mount. The correction of 9/16″ is used in the formulation of distance UT. The lines rl, rl′ and rl″ are all parallel, and rl′=rl″.

To create the necessary declination angle between plate 60, (line ST) and polar shaft 36 (line rl), line SQR must be longer than line UT by an amount SQ.

where: $SQ = rl''$ sin (declination)

Line SQR is fixed as the perpendicular distance from plate 60 to point 64 in FIG. 2. UT is the perpendicular distance from TS to point 75 (see FIG. 9).

$$SQR - SQ = QR$$

Since rl′ and rl″ are equal and parallel,
UT=QR and $VT = UT - 9/16$

In the foregoing explanation of the operation of a polar antenna mount, it was stated that an imaginary cone swept out by the rotation of a dish about its polar axis would intercept the equatorial plane at the Clarke Belt. It was also stated that the error induced by the mount's polar axis being offset but parallel to the Earth's polar axis was negligible. For certain satellite communication frequencies this error is negligible, for other frequencies recently put into transmission this error is not negligible. To correct for the tracking error incurred due south, (when distance to the Clarke Belt is considered at the horizons or due east and west when distance to the Clarke Belt is measured at due south), the polar axis of the mount can be tilted away from the Earth's polar axis in the north-south plane. The tilting of the mounts polar axis tips the antenna's "projected cone" and thus, the cone's intersection with the equatorial plane is changed from a circle to an ellipse. The amount of polar axis shaft tilt necessary to produce better tracking is zero at the equator and North Pole, and is a maximum 0.72 degrees at a 40 degree latitude. The method for determining the amount of declination necessary at a given geographic latitude is similar to that previously described except that the calculations are made with the dish pointing due east or west rather than due south as previously depicted.

Figure 10:
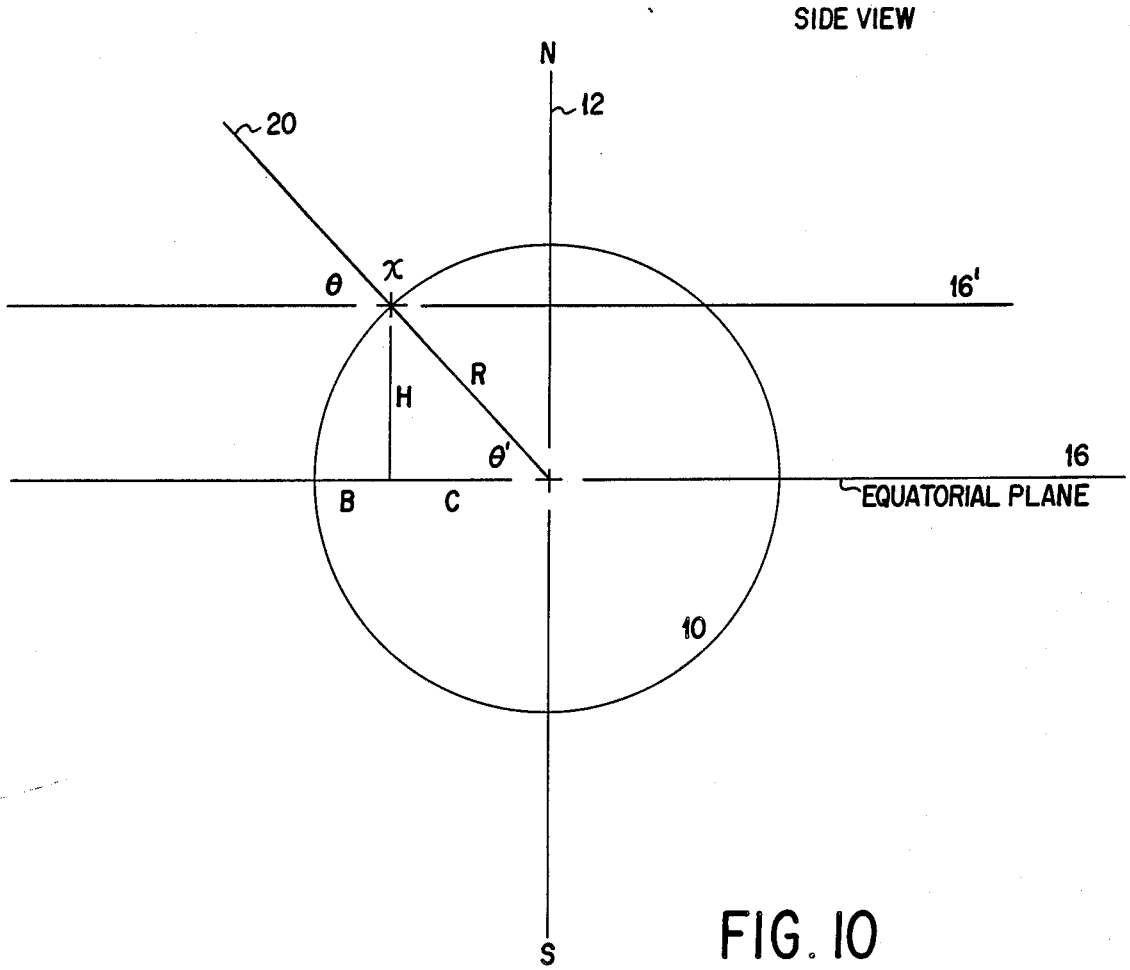
FIG. 10, 11 and 12 relate to declination calculations for recently introduced transmission frequencies.
Figure 11:
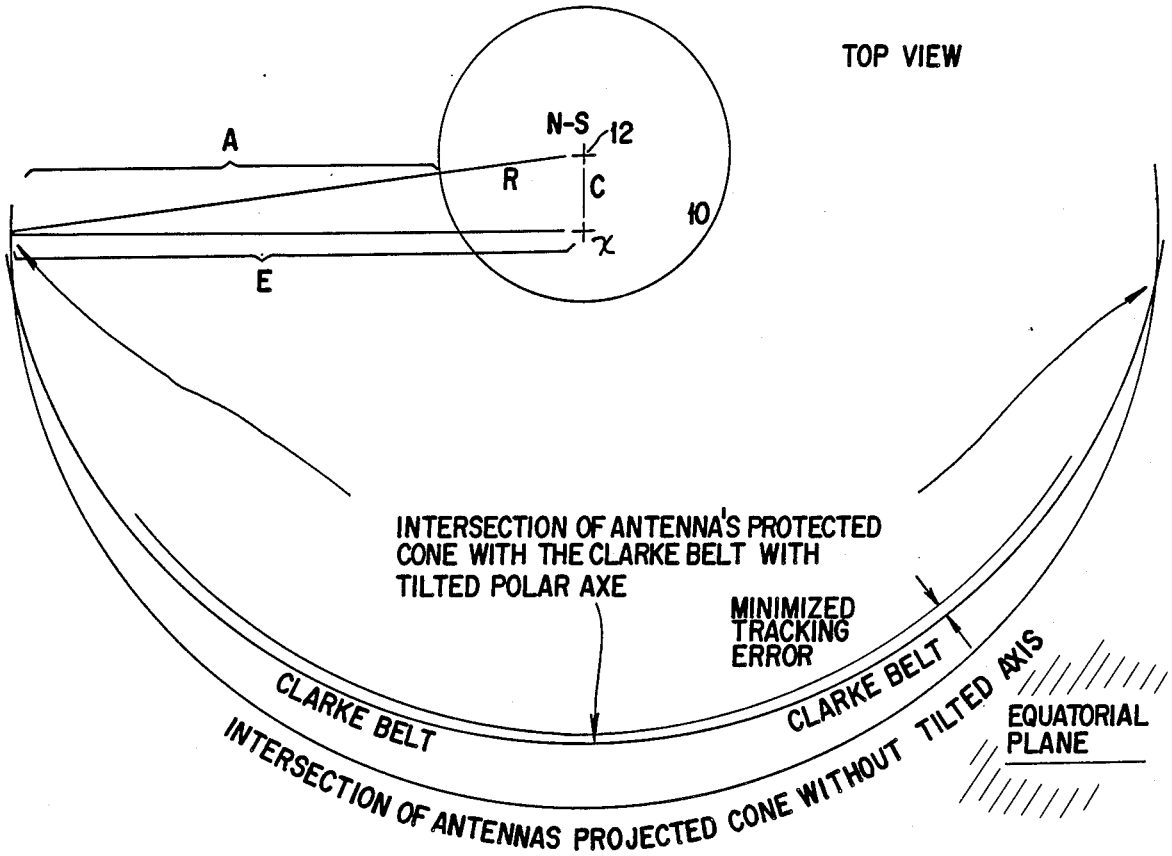
Figure 12:
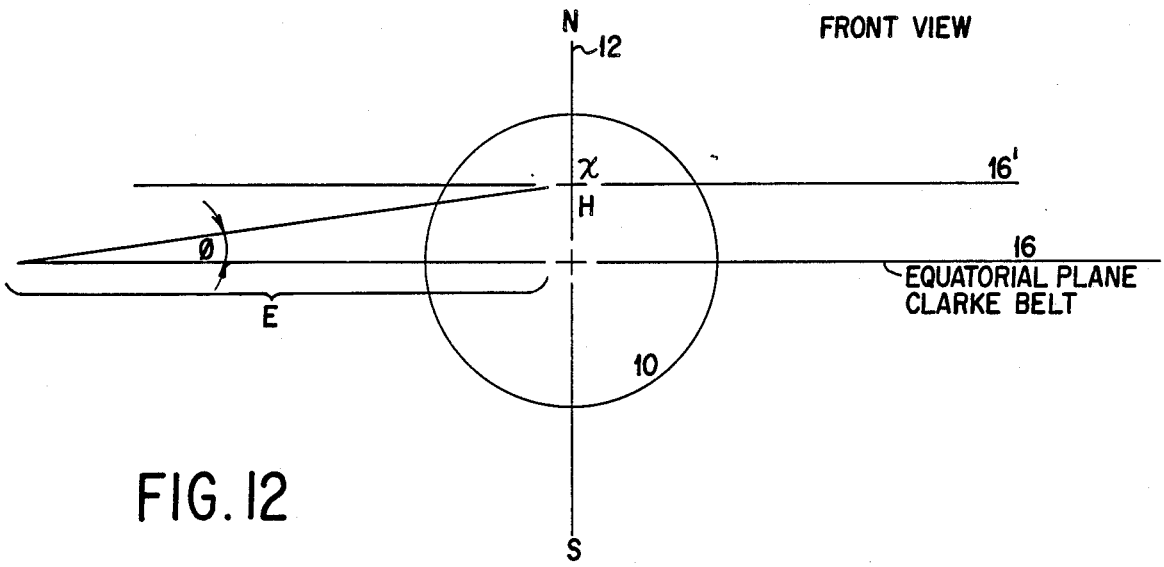

FIGS. 10, 11 and 12 are diagrams and revised figures used in determining the declination at a certain latitude. The calculations used to determine the amount of polar axis tilt are more involved, but the results are given below. Declination calculations, refer to FIGS. 10, 11 and 12.

$$\phi = \tan^{-1}(H/E)$$

Where in FIG. 10

$$B + C = R = 3{,}960 \text{ miles}$$

Where $$C = 3{,}960 \cos \theta$$

$$E = \sqrt{(A + R)^2 - C^2}$$

$$A = 22{,}300 \text{ miles.}$$

| Latitude | Latitude Adjustment | Declination (Ø) |
|---|---|---|
| 20 | +.48° | 2.98 |
| 25 | +.57° | 3.68 |
| 30 | +.65° | 4.35 |
| 35 | +.68° | 4.99 |
| 40 | +.72° | 5.58 |
| 45 | +.71° | 6.13 |
| 50 | +.69° | 6.63 |
| 55 | +.65° | 7.08 |

All other calculations involving the structure of the mount remain the same.

It is to be appreciated that various modifications and adaptations of the invention as disclosed herein may be accomplished by one skilled in the art. Accordingly the scope of the invention is to be measured by the claims set forth hereinbelow.

We claim:

1. An adjustable orientation apparatus, comprising:

first means to be oriented in accordance with a polar angle corresponding to the latitude of the geographical location of said apparatus, and a declination angle of an external object to be tracked by said apparatus;

base means;

second means comprising a polar axis shaft with a substantially, permanently fixed pivot casting and a first support arm, said second means orients said first means at said polar angle by said first support arm being pivotably secured to said base member at a first pivot point;

said first means pivotably connected to said pivot casting at a second pivot point;

third means comprising a sliding cam member and a cam plate, said cam plate secured to said first means, said cam member slidably received on said polar axis shaft at an end opposite said pivot casting, said third means orients said first means at said declination angle by pivotal movement of said first means about said second pivot point;

support means pivotably secured to said base means at a third pivot point and slidably received on said polar axis shaft adjacent said cam member;

manual angle adjustment means which permits adjustment of said polar angle and said declination angle by way of a single adjustment, said adjustment means interconnecting said base means and said support means; wherein, said adjustment means causes said support means to pivot about said third pivot point and to slide along said polar axis shaft, said sliding in turn causes said cam member to slide along said polar axis shaft and said cam plate causing said first means to pivot about said second pivot point, said polar axis shaft pivoting about said first pivot point.

2. An adjustable orientation apparatus according to claim 1, wherein:

said manual angle adjustment means includes a threaded shaft having a first end pivotally connected to said base means, and having a second end extending through an aperture provided in said support means and secured thereto via an adjusting nut; and said threaded shaft has an operative length thereof between said base means and said support means which is adjustable via said adjusting nut to effect said single adjustment.

3. An adjustable orientation apparatus according to claim 2, wherein:

said first means comprises a mounting plate adapted to have an antenna mounted thereon; and said third means includes at least one cam bearing surface provided on a lower side of said mounting plate.

4. An apparatus according to claim 3, wherein:

said support means abuts against said member, so as to normally prevent same from sliding on said polar axis shaft, and to slidably move said member along said polar axis shaft when said operative length of said threaded shaft is adjusted; and whereby orientation of said mounting plate in accordance with said declination angle is effected by rotation thereof about said second pivot point caused by slidable movement of said member in contact with said cam bearing surface simultaneously with, and proportional to, rotation of said support means about said third pivot point and rotation of said polar axis shaft about said first pivot point for orientation in accordance with said polar angle, upon adjustment of said operative length of said threaded shaft.

5. An apparatus according to claim 4, wherein:

said cam bearing surface comprises an inclined proportional ramp having an angle of inclination extending downwardly relative to said mounting plate.

* * * * *